US009995475B2

(12) United States Patent
Kimoto et al.

(10) Patent No.: US 9,995,475 B2
(45) Date of Patent: Jun. 12, 2018

(54) ILLUMINATION DEVICE

(71) Applicant: IWASAKI ELECTRIC CO., LTD., Tokyo (JP)

(72) Inventors: Yuuichi Kimoto, Konosu (JP); Nobuyuki Baba, Konosu (JP); Keiichirou Kinoshita, Konosu (JP)

(73) Assignee: IWASAKI ELECTRIC CO., LTD., Tokyo (JP)

( * ) Notice: Subject to any disclaimer, the term of this patent is extended or adjusted under 35 U.S.C. 154(b) by 214 days.

(21) Appl. No.: 14/890,371

(22) PCT Filed: May 30, 2014

(86) PCT No.: PCT/JP2014/064422

§ 371 (c)(1),
(2) Date: Nov. 10, 2015

(87) PCT Pub. No.: WO2014/192920

PCT Pub. Date: Dec. 4, 2014

(65) Prior Publication Data

US 2016/0161100 A1 Jun. 9, 2016

(30) Foreign Application Priority Data

May 31, 2013 (JP) ..... 2013-115350
May 31, 2013 (JP) ..... 2013-115351
May 31, 2013 (JP) ..... 2013-115352

(51) Int. Cl.
*F21V 29/71* (2015.01)
*F21V 7/00* (2006.01)
(Continued)

(52) U.S. Cl.
CPC ..... *F21V 29/713* (2015.01); *F21S 2/005* (2013.01); *F21V 7/0083* (2013.01); *F21V 15/02* (2013.01);
(Continued)

(58) Field of Classification Search
CPC ..... F21V 29/713; F21V 29/51; F21V 29/74; F21V 15/02; F21V 7/0083; F21V 7/22;
(Continued)

(56) References Cited

U.S. PATENT DOCUMENTS 5,586,015 A 12/1996 Baldwin et al.
7,506,986 B2 3/2009 Koba et al.
(Continued)

FOREIGN PATENT DOCUMENTS

CN 1648761 A 8/2005
CN 101025256 A 8/2007
(Continued)

OTHER PUBLICATIONS

Office Action dated Nov. 22, 2016 for the related U.S. Appl. No. 14/890,274.
(Continued)

*Primary Examiner* — David V Bruce
(74) *Attorney, Agent, or Firm* — Leason Ellis LLP

(57) ABSTRACT

An illumination device that can obtain high withstanding voltage performance while making heat transfer to a casing from a light-emitting element favorable is provided. In a sports illumination device including a COB type LED as a light source in a casing, a base plate that has the COB type LED mounted thereon and is formed from a high thermo-conductive material, to which heat of the COB type LED is transferred, is included, the casing is provided with an engaging hole with which the base plate is engaged in a state in which a part of the base plate is exposed outside the casing, and an insulation packing is provided at a site of contact of the base plate and the engaging hole in the casing.

10 Claims, 13 Drawing Sheets

(51) Int. Cl.

| | |
|---|---|
| ***F21V 17/12*** | (2006.01) |
| ***F21V 29/51*** | (2015.01) |
| ***F21S 2/00*** | (2016.01) |
| ***F21V 15/02*** | (2006.01) |
| *F21W 131/105* | (2006.01) |
| *F21V 29/74* | (2015.01) |
| *F21V 7/22* | (2018.01) |
| *F21Y 115/10* | (2016.01) |

(52) U.S. Cl.
CPC ..... *F21V 17/12* (2013.01); *F21V 29/51* (2015.01); *F21V 7/22* (2013.01); *F21V 29/74* (2015.01); *F21W 2131/105* (2013.01); *F21Y 2115/10* (2016.08)

(58) Field of Classification Search
CPC . F21S 2/005; F21Y 2115/10; F21W 2131/105
See application file for complete search history.

(56) References Cited

U.S. PATENT DOCUMENTS

| | | | |
|---|---|---|---|
| 8,294,356 | B2 | 10/2012 | Suwa et al. |
| 8,430,536 | B1 | 4/2013 | Zhao |
| 2006/0181882 | A1 | 8/2006 | Gordin et al. |
| 2008/0111949 | A1* | 5/2008 | Shibata ..... G02F 1/133603 349/64 |
| 2010/0067226 | A1 | 3/2010 | Higuchi et al. |
| 2010/0142202 | A1 | 6/2010 | Sugishita et al. |
| 2010/0208473 | A1 | 8/2010 | Sakai et al. |
| 2011/0075421 | A1 | 3/2011 | Lai |
| 2011/0180819 | A1 | 7/2011 | Van Elmpt et al. |
| 2011/0205741 | A1 | 8/2011 | Suzuki |
| 2013/0051012 | A1 | 2/2013 | Oehle et al. |
| 2013/0063937 | A1 | 3/2013 | Ahn et al. |
| 2013/0070165 | A1 | 5/2013 | Shimizu |
| 2014/0003046 | A1 | 1/2014 | Matsuda |
| 2014/0111986 | A1 | 4/2014 | Matsuda et al. |

FOREIGN PATENT DOCUMENTS

| | | | |
|---|---|---|---|
| CN | 101761799 | A | 6/2010 |
| CN | 101761811 | A | 6/2010 |
| CN | 101978209 | A | 2/2011 |
| CN | 202002062 | U | 10/2011 |
| CN | 202068617 | U | 12/2011 |
| CN | 202118810 | U | 1/2012 |
| CN | 102725581 | A | 10/2012 |
| CN | 102822591 | A | 12/2012 |
| CN | 202852603 | U | 4/2013 |
| CN | 202947079 | U | 5/2013 |
| CN | 203036430 | U | 7/2013 |
| EP | 2221522 | A | 8/2010 |
| JP | 01-253101 | A | 10/1989 |
| JP | 07-141903 | A | 6/1995 |
| JP | 07-211103 | A | 8/1995 |
| JP | 08-124402 | A | 5/1996 |
| JP | 2008-34342 | A | 2/2008 |
| JP | 2008-098028 | A | 4/2008 |
| JP | 2009-087644 | A | 4/2009 |
| JP | 3158033 | U | 3/2010 |
| JP | 2010-198952 | A | 9/2010 |
| JP | 2010-272527 | A | 12/2010 |
| JP | 2011-075854 | A | 4/2011 |
| JP | 4798006 | B | 8/2011 |
| JP | 2011-234583 | A | 11/2011 |
| JP | 2012-009280 | A | 1/2012 |
| JP | 2012-503306 | A | 2/2012 |
| JP | 2012-227050 | A | 11/2012 |
| JP | 2013-030599 | A | 2/2013 |
| JP | 2013-58467 | A | 3/2013 |
| JP | 2013-089580 | A | 5/2013 |
| JP | 2014-203548 | A | 10/2014 |
| WO | WO-2011/158555 | A | 12/2011 |

OTHER PUBLICATIONS

Office Action dated Jul. 4, 2017 for the corresponding Chinese Patent Application No. 201480026960.3.
Advisory Action dated Jun. 22, 2017 for the related U.S. Appl. No. 14/890,274.
Office Action dated Nov. 2, 2016 for the corresponding Chinese Patent Application No. 201480026960.3.
International Search Report with Written Opinion dated Oct. 29, 2013 for the related PCT Application No. PCT/JP2013/072432.
International Preliminary Report on Patentability dated Dec. 10, 2015 for the related PCT Application No. PCT/JP2013/072432.
International Search Report with Written Opinion dated Aug. 26, 2014 for the corresponding PCT Application No. PCT/JP2014/064422.
International Preliminary Report on Patentability dated Dec. 10, 2015 for the corresponding PCT Application No. PCT/JP2014/064422.
Office Action dated Jul. 28, 2015 for the corresponding Japanese Application No. 2013-115350.
Office Action dated Feb. 10, 2015 for the corresponding Japanese Application No. 2013-115351.
Office Action dated Dec. 8, 2015 for the corresponding Japanese Application No. 2013-115352.
Office Action dated Jul. 28, 2015 for the corresponding Japanese Application No. 2013-115352.
Office Action dated Nov. 10, 2015 for the related Japanese Application No. 2015-519601.
Office Action dated Apr. 12, 2017 for the related U.S. Appl. No. 14/890,274.
Office Action dated May 4, 2017 for the related Chinese Patent Application No. 201380076922.4.
Office Action dated Sep. 9, 2016 for the related Chinese Patent Application No. 201380076922.4.
Office Action dated Apr. 12, 2016 for the corresponding Japanese Patent Application No. 2015-519601.
Office Action dated Dec. 29, 2017 for the corresponding Chinese Patent Application No. 201480026960.3.

* cited by examiner (A)

(B)

ILLUMINATION DEVICE

CROSS-REFERENCE TO RELATED PATENT APPLICATIONS

This application is a U.S. National Phase Application under 35 U.S.C. § 371 of International Patent Application No. PCT/JP2014/064422, filed May 30, 2014, and claims the benefit of Japanese Patent Applications No. 2013-115350, filed May 31, 2013, No. 2013-115351, filed May 31, 2013 and No. 2013-115352, filed May 31, 2013, all of which are incorporated by reference in their entirety herein. The International Application was published in Japanese on Dec. 4, 2014 as International Publication No. WO/2014/192920 under PCT Article 21(2).

FIELD OF THE INVENTION

The present invention relates to an illumination device including light-emitting elements such as LEDs in a light source.

BACKGROUND OF THE INVENTION

In illumination devices having high-power (high-wattage) type LEDs as light sources, there is known a device in which in order to radiate the heat generated in an LED efficiently, a casing is formed with use of a high thermoconductive material such as a metal and a metal alloy, an LED substrate is attached to the casing, and the heat generated in the LED is transferred to the casing to be radiated.

Further, in general, in the field of an illumination device, a withstanding voltage test that tests withstanding voltage performance by applying a high voltage is performed.

There is also known a device in which in order to prevent excessive voltage application to an LED substrate even when such a high voltage is applied, an electrical insulation member such as a ceramics plate is interposed between the casing and the LED substrate of the illumination device (refer to Japanese Patent Laid-Open No. 2010-198952, for example).

Technical Problem

However, when the ceramics plate is interposed between the LED substrate and the casing, there arises the problem that transfer of heat from the LED substrate to the casing is inhibited, and heat radiation performance is decreased.

The present invention is made in the light of the aforementioned circumstances, and has an object to provide an illumination device that makes heat transfer to a casing from light-emitting elements used in a light source favorable, and obtains sufficient withstanding voltage performance.

SUMMARY OF THE INVENTION

Solution to Problem

The entire contents of Japanese Patent Application No. 2013-115350, Japanese Patent Application No. 2013-115351 and Japanese Patent Application No. 2013-115352 which are filed in Japan on May 31, 2013 are incorporated in this description.

In order to achieve the above described object, the present invention is directed to an illumination device including a light source having a light-emitting element substrate on which a light-emitting element is mounted, and a casing, and includes a substrate mounting member that has the light-emitting element substrate mounted thereon and is formed from a high thermoconductive material, to which heat of the light-emitting element mounted on the light-emitting element substrate is transferred, wherein the casing is provided with an engaging hole with which the substrate mounting member is engaged in a state in which a part of the substrate mounting member is exposed outside the casing, and an electrical insulation member is provided in a site of contact of the substrate mounting member and the engaging hole in the casing.

Further, the present invention is the above described illumination device, and includes a heat radiation section that is protruded outside the casing from the engaging hole, and radiates heat of the substrate mounting member.

Further, the present invention is the above described illumination device, wherein the heat radiation section includes a heat radiation fin that is disposed outside the casing, and a heat pipe that transfers the heat of the substrate mounting member to the heat radiation fin.

Further, the present invention is the above described illumination device, wherein the substrate mounting member is provided with a pipe groove in which the heat pipe passes, and a section of the pipe groove is adapted to a shape of an outer circumferential surface that is after thermal deformation which occurs due to heating to the heat pipe accompanying surface treatment.

Further, the present invention is the above described illumination device, and includes a plurality of reflecting mirrors in shapes of bodies of revolution that are separated from each other, wherein the respective reflecting mirrors are arranged on a same circumference, and edge portions of openings at tip end sides of the reflecting mirrors adjacent to one another abut on one another.

Further, the present invention is the above described illumination device, wherein the respective reflecting mirrors are coupled to the casing by a screwing method, and engaging portions that are engaged with the edge portions of the openings at the tip end sides of the reflecting mirrors adjacent to one another and restrain rotation in a direction to loosen the screwing are equipped at the edge portions of the openings at the tip end sides of the respective reflecting mirrors.

Further, the present invention is the above described illumination device, and includes a plurality of the light sources, the reflecting mirror provided for each of the light sources, and a heat radiation section that protrudes outside of the casing from the engaging hole of the casing, and radiates heat of the substrate mounting member, wherein the heat radiation sections are disposed in positions corresponding to the respective reflecting mirrors.

Further, the present invention is the above described illumination device, wherein the reflecting mirror is formed from a resin material.

Further, the present invention is the above described illumination device, and includes a heat radiation section that protrudes outside from a back face of the casing from the engaging hole, and radiates heat of the substrate mounting member, and a back face guard member that is provided at the casing, and covers the heat radiation section at the back face, wherein the back face guard member includes an opening and closing section that opens and closes in a back direction of the casing, and the opening and closing section is provided to be removable in a direction substantially perpendicular to the back direction.

Advantageous Effects of Invention

According to the present invention, the substrate mounting member is configured to be engaged with the engaging hole of the casing in the state in which a part of the substrate mounting member is exposed outside the casing, and therefore, the heat of the light-emitting element which is transferred to the substrate mounting member can be efficiently radiated from the site exposed outside the casing.

Further, since the electrical insulation member is provided at the site of contact of the substrate mounting member and the engaging hole in the casing, electrical insulation between the substrate mounting member and the casing is sufficiently ensured, and sufficient withstanding voltage performance is obtained, even in the configuration in which the light-emitting element substrate is directly mounted on the substrate mounting member, and heat transfer to the substrate mounting member from the light-emitting element substrate is made favorable.

That is, according to the present invention, there is provided the effect of realizing high heat radiation performance by keeping heat transfer to the substrate mounting member from the light-emitting element substrate favorable, and obtaining sufficient withstanding voltage performance.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Hereinafter, an embodiment of the present invention will be described with reference to the drawings.

Figure 1:
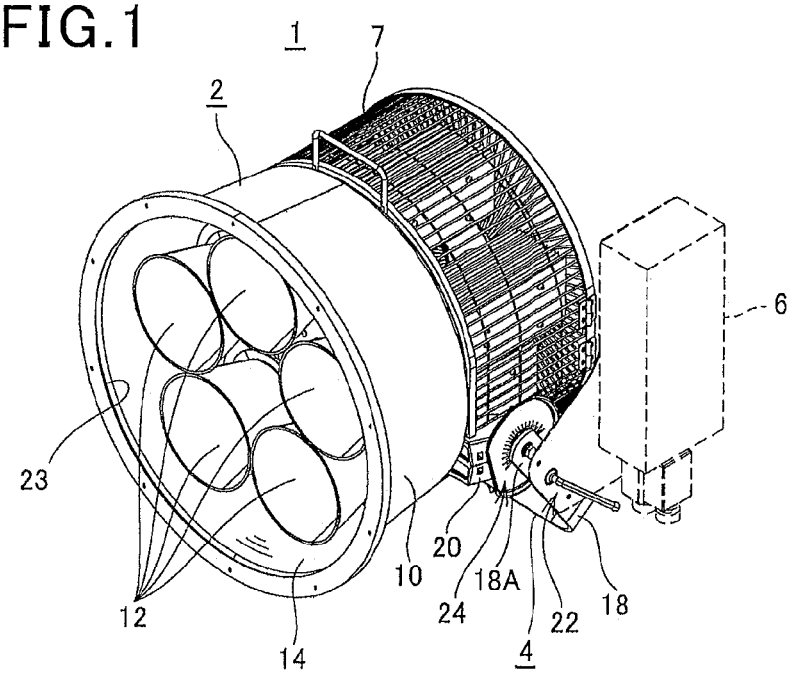
FIG. 1 is a perspective view of a sports illumination device according to an embodiment of the present invention, (A) is a perspective view of the sports illumination device seen from an upper front, and (B) is a perspective view of the sports illumination device seen from a lower front.
Figure 1:
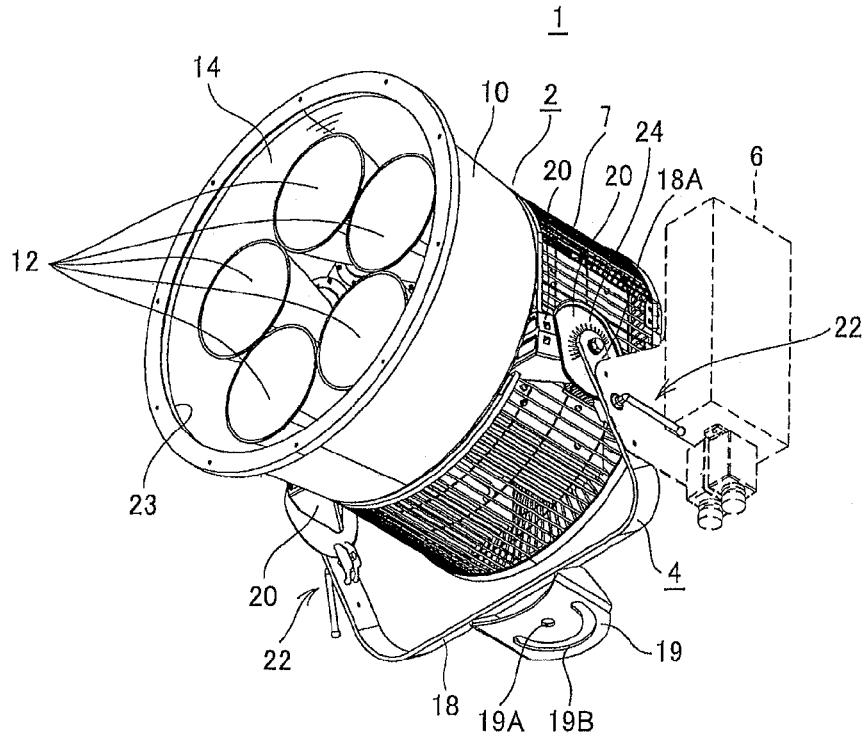
Figure 2:
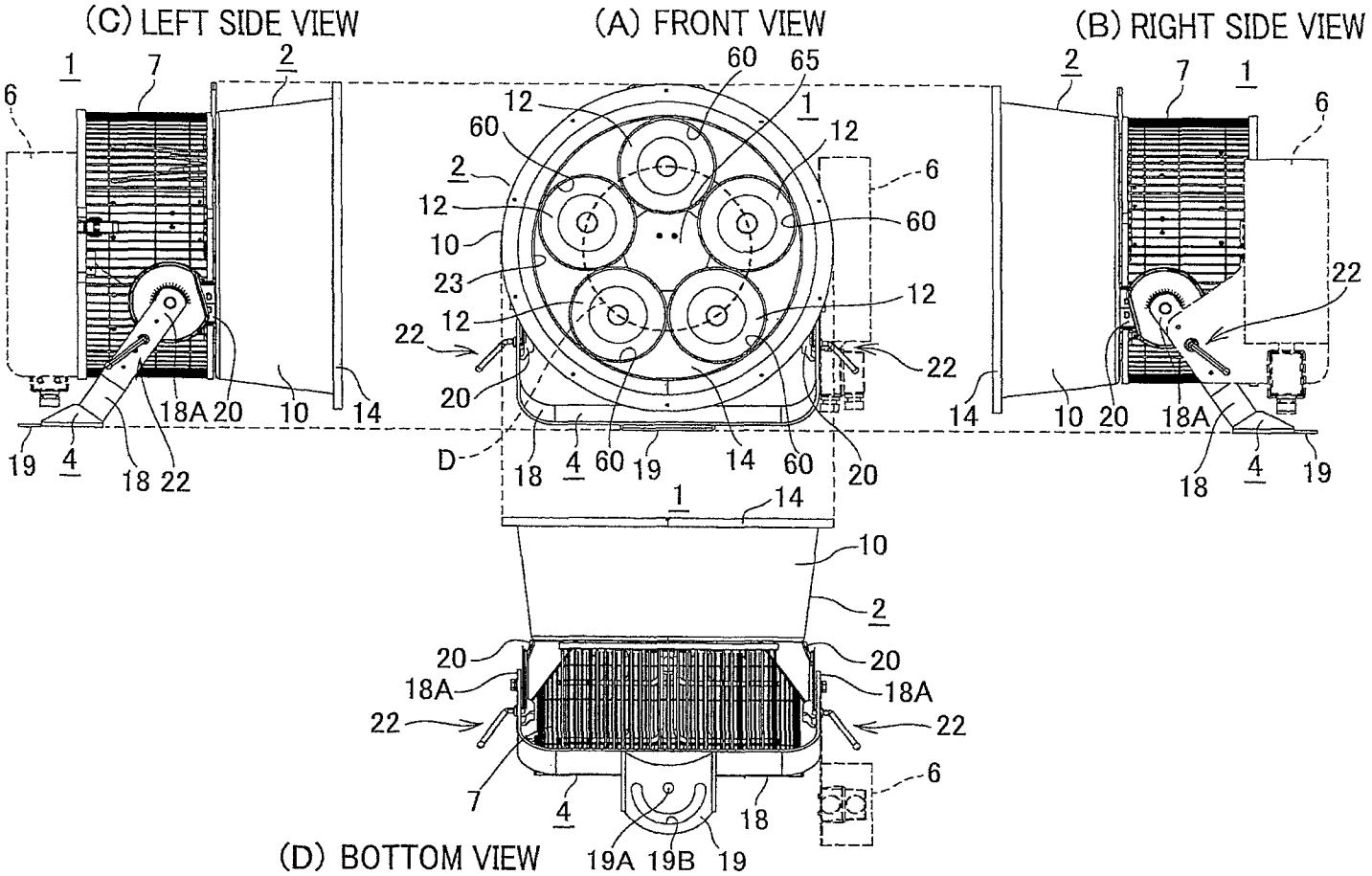
FIG. 2 is a view showing a configuration of the sports illumination device, (A) is a front view, (B) is a right side view, (C) is a left side view, and (D) is a bottom view.

FIG. 1 is a perspective view of a sports illumination device 1 according to the present embodiment, FIG. 1 (A) is a perspective view of the sports illumination device 1 seen from an upper front, and FIG. 1 (B) is a perspective view of the sports illumination device 1 seen from a lower front. FIG. 2 is a view showing a configuration of the sports illumination device 1, FIG. 2 (A) is a front view, FIG. 2 (B) is a right side view, FIG. 2 (C) is a left side view, and FIG. 2 (D) is a bottom view.

The sports illumination device 1 is an illumination device that lights an outdoor ball game ground and an outdoor stadium from a spectator stand side, and as shown in FIG. 1 and FIG. 2, the sports illumination device 1 mainly includes a device main body 2, a mounting arm section 4, a power supply box 6, and a back face guard member 7.

The device main body 2 includes a casing 10 in a bottomed cylindrical shape with a depth that is shallow relatively to a diameter, a plurality of (five in the illustrated example) light source modules 12 that are provided in the casing 10, and a front cover 14. The light source modules 12 are respectively equipped with LEDs that are examples of light-emitting elements as light sources, and as the LEDs, COB type LEDs 30 (FIG. 7) that are examples of high-power type LEDs are used.

The light source of the sports illumination device 1 is configured by these plurality of light source modules 12, and light outputs of the respective light source modules 12 are designed so as to obtain brightness equal to or higher than predetermined brightness that is required by sports to be played in a ball game ground or a stadium that is an object to be lighted. Note that the sports illumination device 1 may be used in lighting for other outdoor sports facilities without being limited to a ball game ground and a stadium, as a matter of course.

The mounting arm section 4 is a mounting member for fixing the sports illumination device 1 to an installation surface, and includes a function of rotatably supporting the device main body 2. Specifically, the mounting arm section 4 includes a U-shaped support frame 18 that is mounted in such a manner as to interpose the casing 10 therebetween, and a fixing plate 19 is provided at the support frame 18. The fixing plate 19 is provided with a bolt hole 19A and a swing slit 19B, and is fixed to the installation surface by inserting fixing bolts through the respective bolt hole 19A and swing slit 19B, whereby the sports illumination device 1 is firmly fixed. The swing slit 19B is a slit in a circular arc shape with the bolt hole 19A as a center, and thereby, the sports illumination device 1 is rotated along the swing slit 19B to be able to adjust an irradiation direction.

Further, at both left and right sides of the casing 10, coupling pieces 20 that extend backward are provided, end portions 18A of the support frame 18 are pivotally supported by the coupling pieces 20, and the casing 10 and the support frame 18 are rotatably coupled.

Further, the mounting arm section 4 includes stopper mechanisms 22 that make the coupling pieces 20 incapable of rotating, in the support frame 18, and by the stopper mechanisms 22, the casing 10 can be hold at a predetermined angle relatively to the support frame 18. Further, in the coupling piece 20, a scale 24 that indicates rotation angles is attached to a periphery of a rotation axis of the support frame 18, so that a worker accurately sets an angle between the support frame 18 and the casing 10 with the aid of the scale 24 at a time of installation.

The power supply box 6 is a box body where a power supply circuit that generates lighting power of the respective light source modules 12 by receiving an input of a commercial power supply that is supplied from an outside is incorporated, and is disposed outside the casing 10. From the power supply box 6, a power supply line (not illustrated) that supplies the lighting power to the light source modules 12 is led out, is led into an inside from a leading-in section 17 (FIG. 4) that is provided in a center in a back face of the casing 10, and is connected to the COB type LEDs 30 of the respective light source modules 12.

Since in the sports illumination device 1, the power supply box 6 is provided outside the casing 10, the casing 10 can be made compact, and a total weight of the device main body 2 is light. In particular, in the sports illumination device 1, the power supply box 6 is mounted to the mounting arm section 4, the total weight of the device main body 2 which the support frame 18 supports is reduced, and a load that is applied to a coupling portion of the support frame 18 and the device main body 2 is reduced.

Note that the power supply box 6 is formed from a material that is light in weight and excellent in heat conductivity (that is, a heat radiation property) such as aluminum, for example, and is internally provided, in accordance with necessity, with a cooling mechanism such as a fan that air-cools the power supply circuit. Further, a mounting mode of the power supply box 6 to the mounting arm section 4 is not limited to the illustrated example. The power supply box 6 can be also provided independently from the sport illumination device 1.

Figure 3:
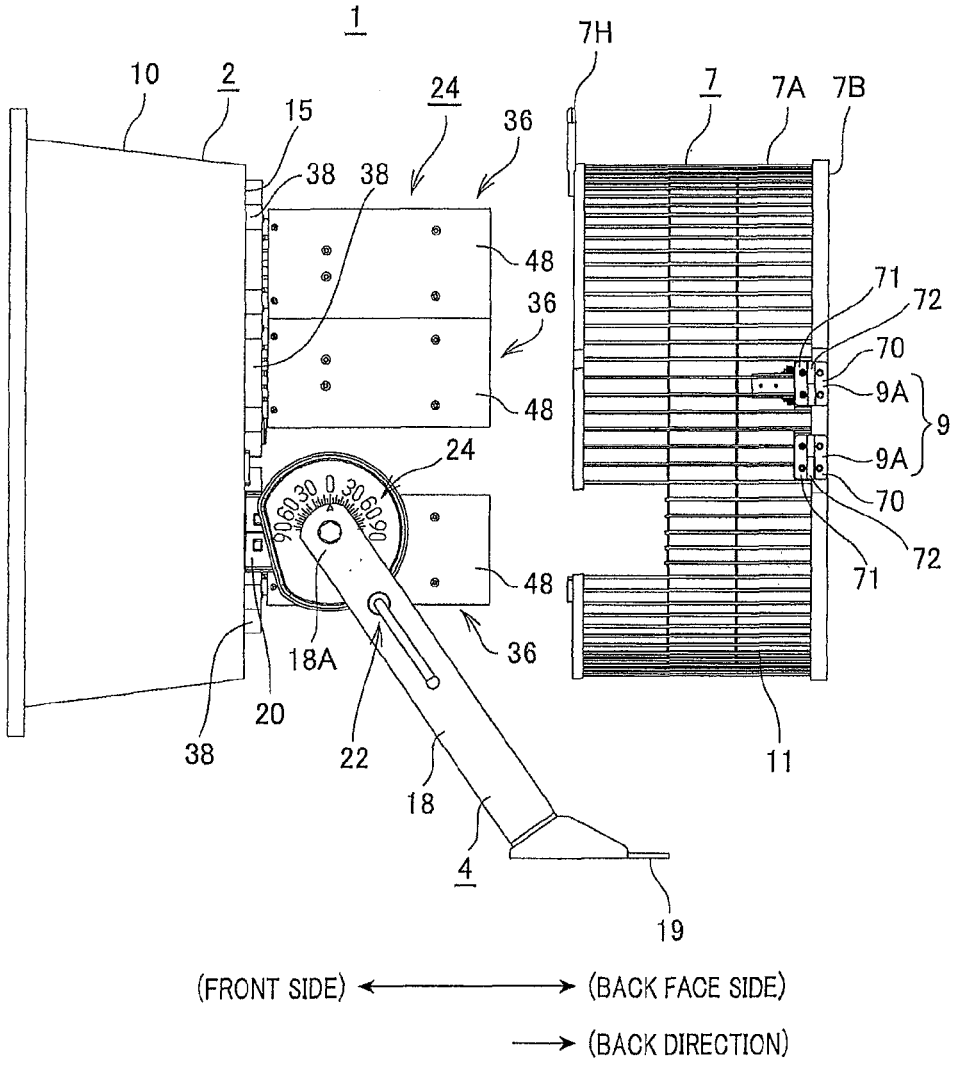
FIG. 3 is a side view showing a state in which a back face guard member is removed from a sports illumination device.
Figure 4:
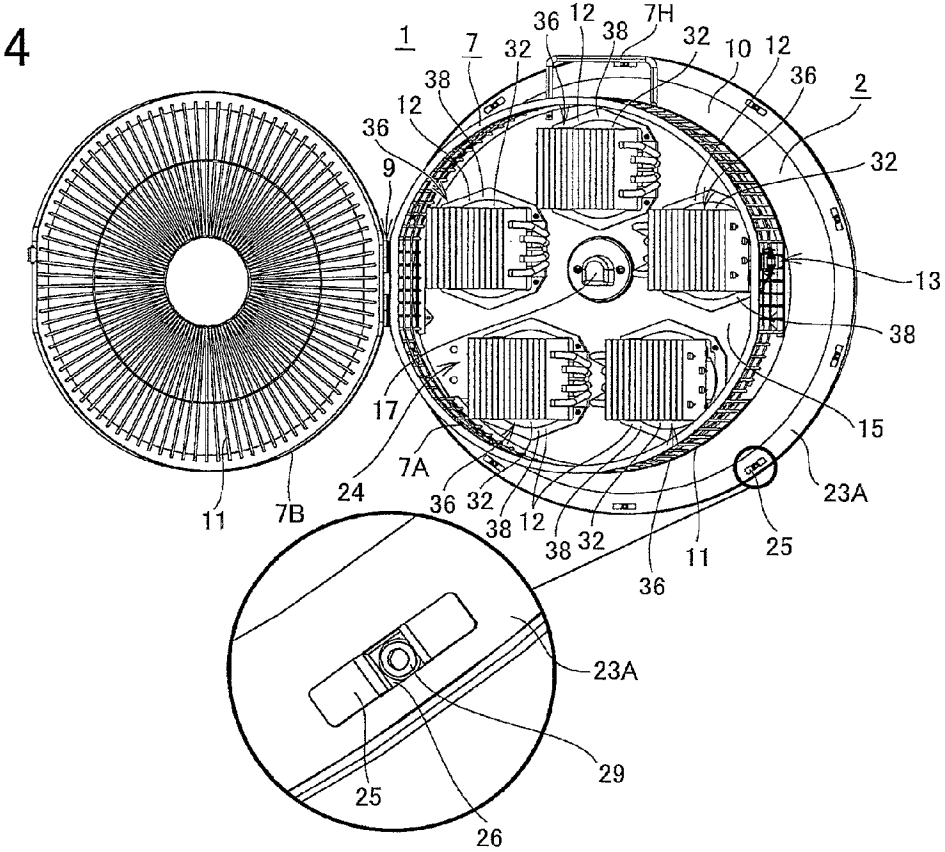
FIG. 4 is a perspective view showing a state in which the back face guard member of the sports illumination device is brought into an open state.

FIG. 3 is a side view showing a state in which the back face guard member 7 is removed from the sports illumination device 1, and FIG. 4 is a perspective view showing a state in which the back face guard member 7 of the sports illumination device 1 is opened. In FIG. 3, illustration of the power supply box 6 is omitted, and in FIG. 4, illustration of the member is properly omitted.

The back face guard member 7 is a member which is mounted to the casing 10 and protects each kind of structure 24 equipped on a back face 15 of the casing 10. As shown in FIG. 3 and FIG. 4, the back face guard member 7 includes a tubular section 7A having a substantially same diameter as the casing 10, and an opening and closing section 7B that covers an opening of the tubular section 7A. The tubular section 7A and the opening and closing section 7B are configured by assembling a number of slim guide bars 11 into a grid shape, a radial shape or the like, and sufficient ventilation as well as rigidity that can withstand collision by a ball and the like is ensured. Further, gaps among the guide bars 11 are narrowed to such an extent that a bird cannot enter the gaps, so as to prevent a bird nest or the like from being made in the structure 24.

The back face guard member 7 is provided with a grip section 7H to be gripped at a time of adjusting the irradiation direction of the device main body 2, or the like.

The opening and closing section 7B is coupled to the tubular section 7A by a hinge coupling section 9 to be openable and closable in a back direction, and is coupled to the tubular section 7A by a latch mechanism 13 to be incapable of opening and closing. The latch mechanism 13 is released and the opening and closing section 7B is opened, whereby an access is made to the structure 24 on the back face 15 and a maintenance work or the like can be performed without removing a whole of the back face guard member 7. The opening and closing section 7B is configured to be removable from the tubular section 7A in a direction perpendicular to the opening and closing direction, and this will be described later.

Next, a configuration of the aforementioned device main body 2 will be described in detail.

The casing 10, as described above, forms the shape of a bottomed cylinder with the depth shallow relatively to the diameter, and an opening at the front face is configured as an emission port 23. The casing 10 is formed from an aluminum that is a kind of a so-called light metal having a relatively small specific gravity, and the device main body 2 is further reduced in weight, in combination with an external attachment structure of the power supply box 6.

Figure 5:
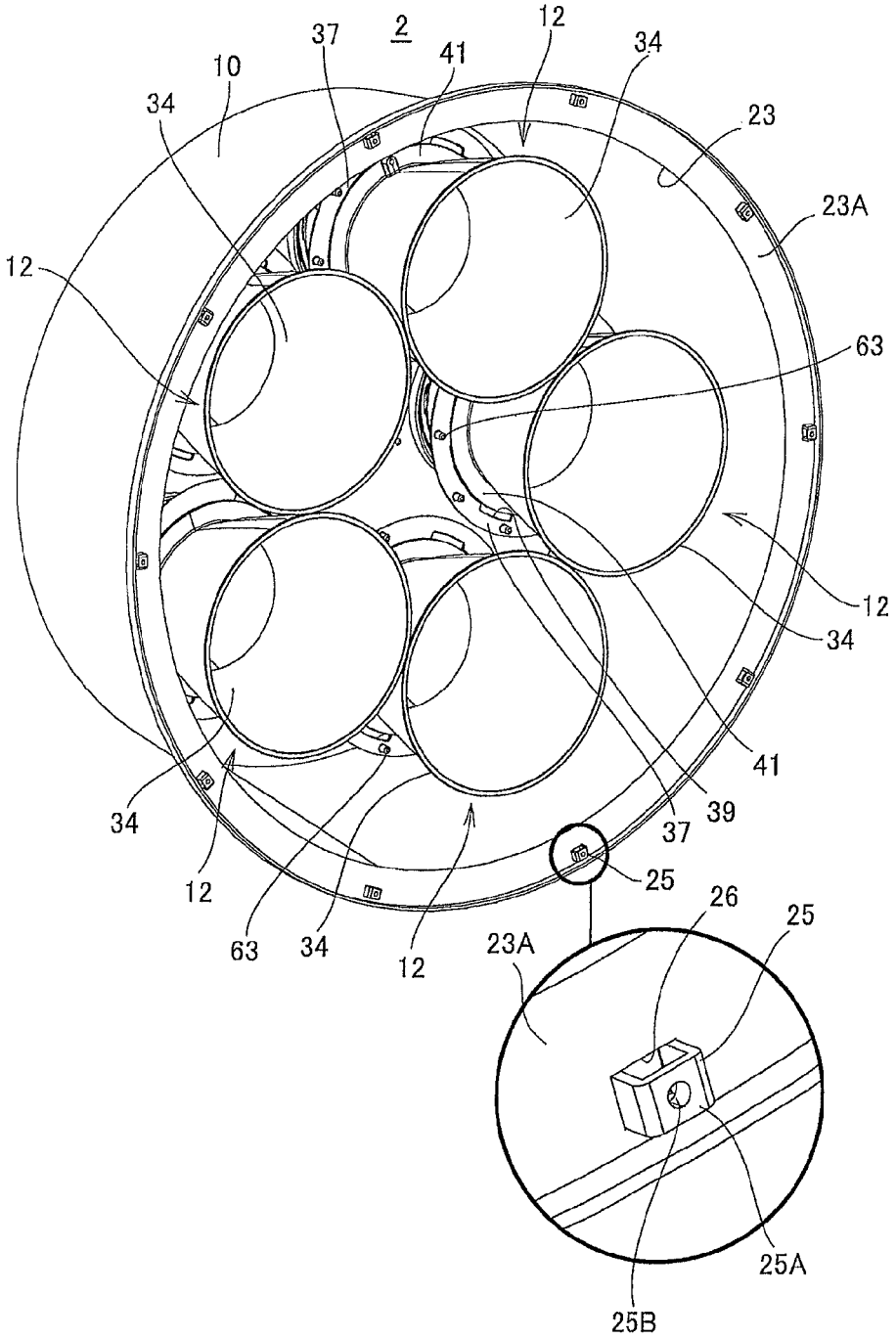
FIG. 5 is a perspective view showing a state in which a front cover is removed from a device main body.

FIG. 5 is a perspective view showing a state in which the front cover 14 is removed from the device main body 2.

The front cover 14 is a translucent member that covers the emission port 23 of the casing 10, and for the purpose of reducing the weight, and preventing scattering due to collision with a ball and the like, the front cover 14 is formed from a polycarbonate resin. The front cover 14 is firmly coupled by being fastened to a flange 23A of the emission port 23 with a screw 29 (FIG. 4).

Here, the casing 10 is formed from an aluminum to reduce the weight as described above, there arises the problem that strength of a screw hole is too low when the screw hole for screw-fastening the front cover 14 is provided in the flange 23A.

In order to solve the problem, it is conceivable to reinforce the strength of the screw hole by making the flange 23A thick, overlaying another member and the like, but this causes the problem that the manufacture cost becomes high.

Therefore, in the sports illumination device 1, the above problems are solved as follows.

That is, as shown in FIG. 4 and FIG. 5, the screw hole which is screwed onto the screw 29 is not provided in the flange 23A of the casing 10, but a hat type metal fitting 25 to which the front cover 14 is fastened by screwing is provided on the flange 23A. Specifically, in the flange 23A, metal fitting insertion holes 26 are formed at predetermined intervals around the emission port 23. Further, the hat type metal fitting 25 has a seat portion 25A (FIG. 5) that is formed by a substantially central portion of a plate-shaped member protruding, and in the seat portion 25A, a screw hole 25B in which the screw 29 is screwed is formed. The hat type metal fitting 25 is fixed by, for example, welding, screw-fastening or the like, in a state in which the seat portion 25A is inserted into the metal fitting insertion hole 26 from a back surface of the flange 23A and is protruded to a surface side. Subsequently, the front cover 14 is fastened by screwing to the respective seat portions 25A which are protruded to the surface side (the front side) of the flange 23A with the screws 29. Thereby, even if the strength of the casing 10 is low, the front cover 14 can be firmly fastened by screwing to the casing 10 by the hat type metal fittings 25.

Figure 6:
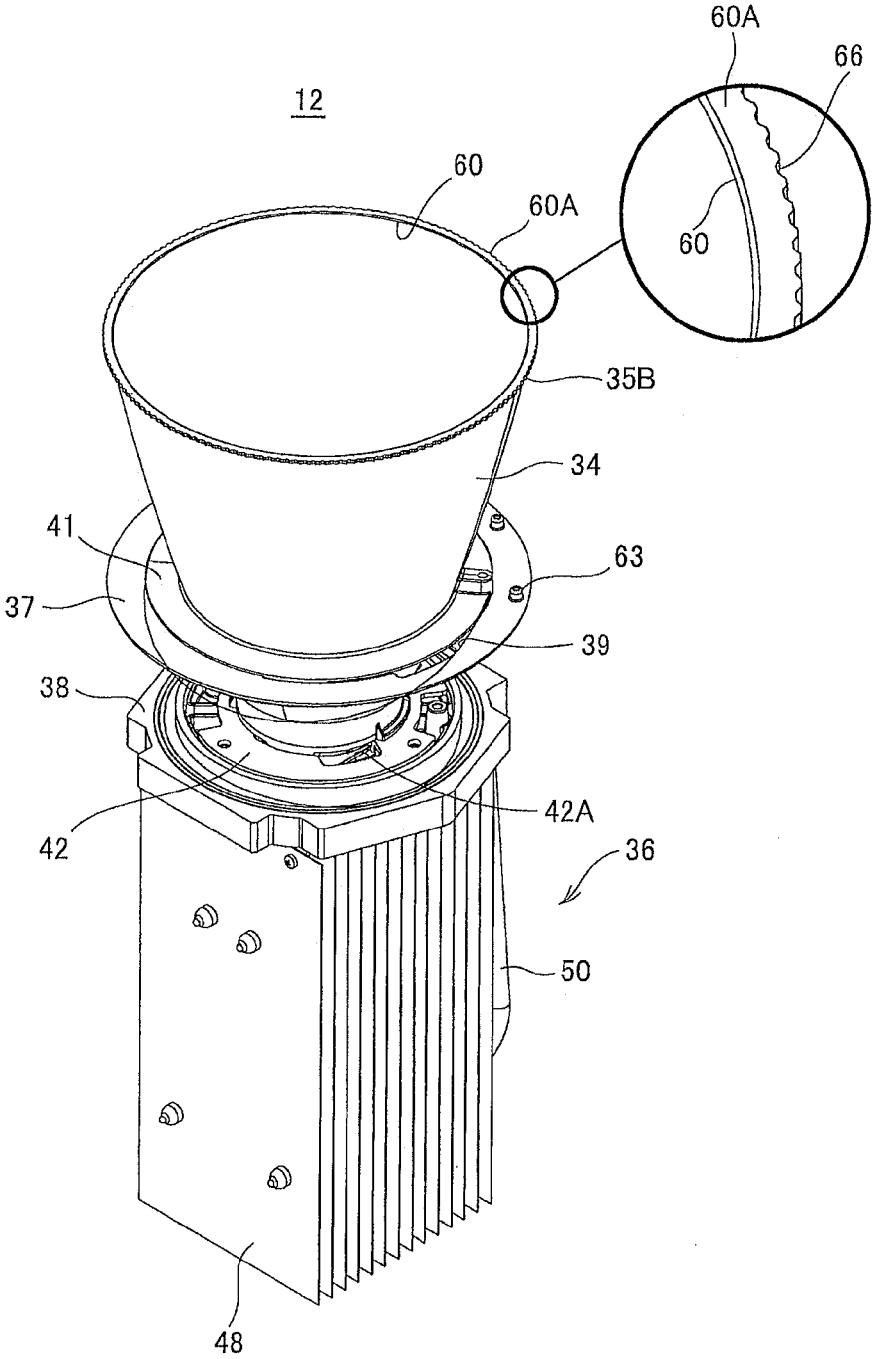
FIG. 6 is a perspective view showing an entire configuration of a light source module.
Figure 7:
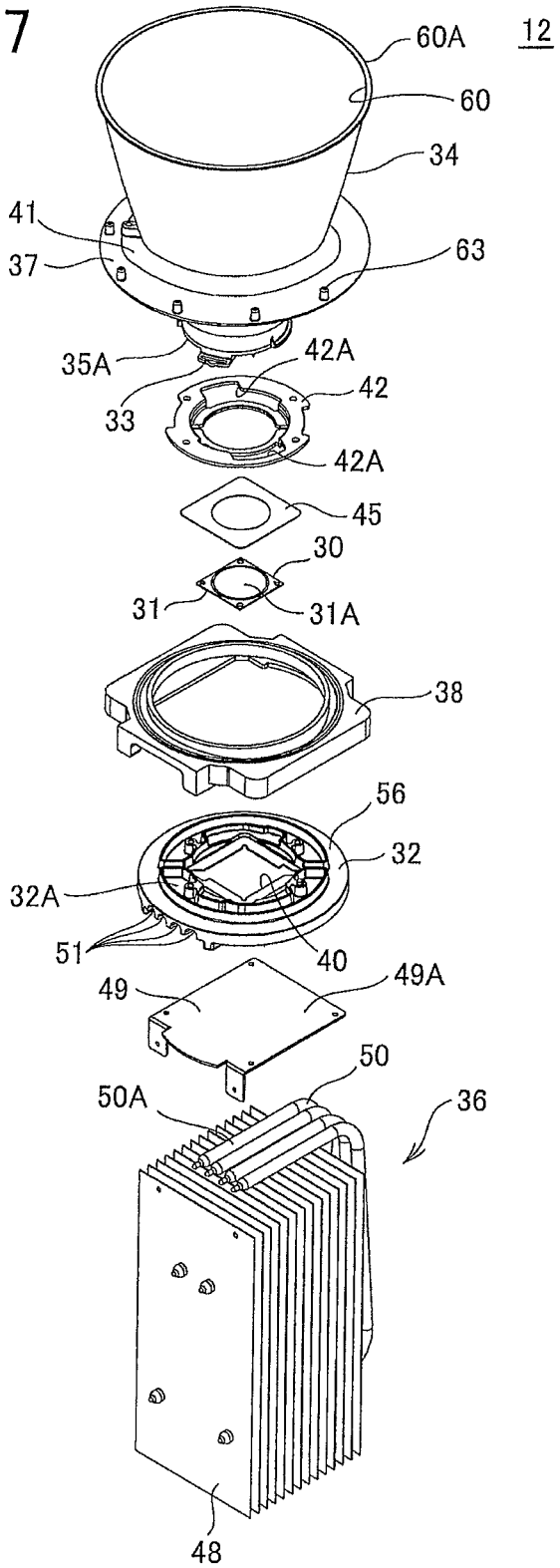
FIG. 7 is an exploded perspective view of the light source module.
Figure 8:
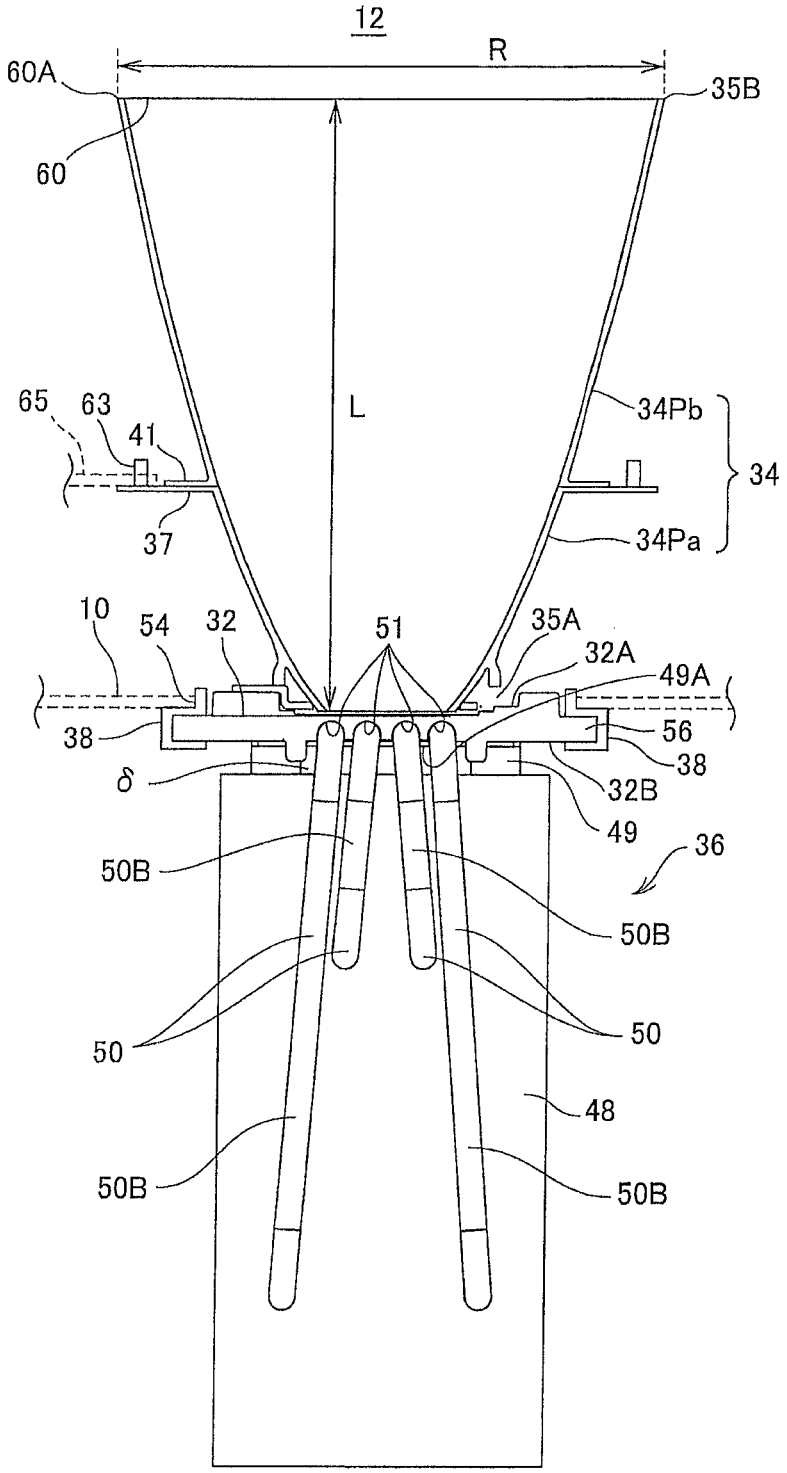
FIG. 8 is a sectional view of the light source module.

FIG. 6 is a perspective view showing an entire configuration of the light source module 12, FIG. 7 is an exploded perspective view of the light source module 12, and FIG. 8 is a sectional view of the light source module 12.

The light source module 12 is a module which includes the COB type LED 30 which is one example of a high power type LED, in the light source, and as shown in the drawings, the light source module 12 mainly includes the COB type LED 30 (FIG. 7), a base plate 32 as a mounting member for a substrate of the COB type LED 30, a reflecting mirror 34 as a light control member, a heat radiation section 36, and an insulation packing 38.

As shown in FIG. 7, the COB type LED 30 is a light-emitting device of a chip on board (Chip On Board: COB) structure forming a planar light emitting section 31A substantially circular in plan view (can be rectangular) by densely disposing a number of LED on an LED substrate 31. Since a number of LEDs are densely disposed, the COB type LED 30 is an LED light source with a large amount of light and high brightness.

The base plate 32 is a substrate mounting member on which the COB type LED 30 is directly mounted, and is formed from an aluminum being a metal, for example, which is a high thermoconductive material. As shown in FIG. 7, the base plate 32 is formed into a substantially disk shape, an LED accommodation recessed section 40 is provided in a center of a surface 32A thereof, the LED substrate 31 of the above described COB type LED 30 is accommodated in the LED accommodation recessed section 40, and a top surface thereof is covered with a translucent sheet 45.

The translucent sheet 45 is a resin sheet having an electrical insulation property. As will be described in detail later, in the base plate 32, the COB type LED 30 is directly placed on the LED accommodation recessed section 40 without a medium of an electrical insulation member or the like.

The insulation packing 38 is a member that is formed from an electrical insulation material such as a resin material, for example, and covers at least an entire circumference of an edge portion 56 of the base plate 32, and details thereof will be described later.

In order to promote heat transfer to the LED accommodation recessed section 40 from the COB type LED 30, heat resistance between both of them may be decreased by coating contact surfaces of both of them with a heat conductive grease or the like, or interposing a heat conductive sheet between the contact surfaces.

A ring-shaped reflecting mirror fixture 42 that surrounds the LED accommodation recessed section 40 is fixed to the surface 32A of the base plate 32 by screwing, and the reflecting mirror 34 is fixed to the reflecting mirror fixture 42. The reflecting mirror fixture 42 is configured to press the LED substrate 31 of the COB type LED 30 and the translucent sheet 45 from above, with fixation by screwing to the base plate 32. Thereby, fixation of the COB type LED 30 is also achieved by fixation of the reflecting mirror fixture 42, and fixation by screwing of the COB type LED 30 to the base plate 32 or the like is not needed.

The reflecting mirror 34 is in a shape of a body of revolution such as a paraboloid of revolution or a spheroid, and is a concave mirror in which a paraboloid of revolution reflection surface or a spheroidal reflection surface that is determined in accordance with predetermined light distribution control is formed on an inner surface thereof. The reflecting mirror 34 is formed of a resin material as a base material and has a surface thereof coated with a reflective material, and is reduced in weight as compared with a case where the reflecting mirror is formed from a metal material.

Further, the reflecting mirror 34 is of a screw type and is mounted and fixed to the reflecting mirror fixture 42. Specifically, at an edge portion of a base end portion 35A of the reflecting mirror 34, a flange portion 33 that is engaged with the reflecting mirror fixture 42 is provided. The reflecting mirror fixture 42 is provided with screw grooves 42A where the above described flange portions 33 are fitted in and the flange portions 33 are engaged incapable of falling off with rotation of the reflecting mirror 34. At a time of fixing the reflecting mirror 34, the flange portions 33 are screwed into the screw grooves 42A, whereby the reflecting mirror 34 can be fixed without using a tool additionally. Further, the flange portion 33 of the reflecting mirror 34 is also formed from a resin material, a spring force (an elastic force) works between the screw groove 42A and the flange portion 33, and a coupling force between the screw groove 42A and the flange portion 33 is enhanced.

Figure 9:
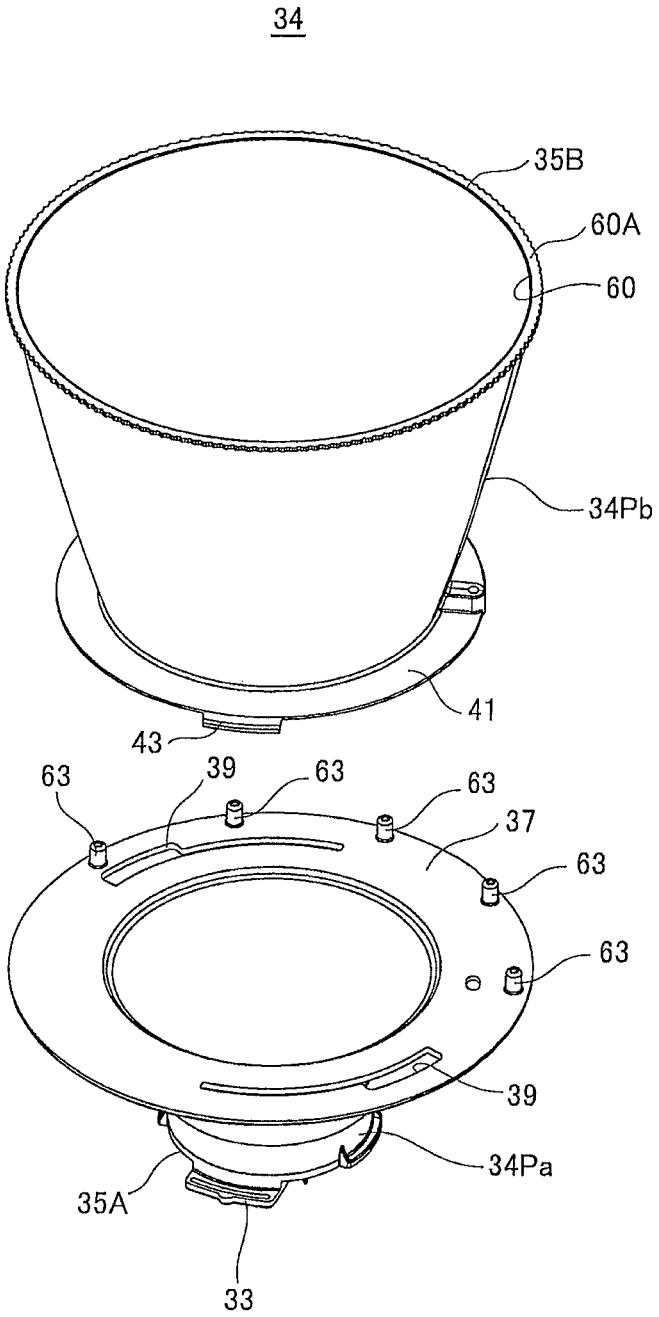
FIG. 9 is an exploded perspective view of a reflecting mirror.

FIG. 9 is an exploded perspective view of the reflecting mirror 34.

As shown in FIG. 9, the reflecting mirror 34 is configured to be dividable into a base end side part 34Pa, and a tip end side part 34Pb, between the base end portion 35A and the tip end portion 35B. That is, the reflecting mirror 34 is used by removing the tip end side part 34Pb from the base end side part 34Pa of the reflecting mirror 34, or the reflecting mirror 34 is used by replacing the tip end side part 34Pb with a part with a different reflection surface, whereby an distribution pattern of the light source module 12 is made easily changeable.

Specifically, the reflecting mirror 34 is configured to be able to obtain a medium angle light distribution with a 1/10 beam angle of 62°, when only the base end side part 34Pa in which mirror finish is applied to a reflection surface is used (configuration 1). In addition to the reflecting mirror 34 of the configuration 1, an embossed cover that is given a light diffusion effect is used in combination as the front cover 14, whereby a medium to wide angle light distribution with a 1/10 beam angle of 63° is obtained (configuration 2). In the reflecting mirror 34 of the configuration 2, a white color coating (namely, light diffusion treatment) is adopted as the treatment of the reflection surface of the base end side part 34Pa in place of the mirror finish, a wide angle light distribution with a 1/10 beam angle of 87° is obtained (configuration 3).

Further, in addition to the reflecting mirror 34 of the above described configuration 1, the tip end side part 34Pb with mirror finish applied to the reflection surface is attached to the base end side part 34Pa, whereby a narrow angle light distribution with a 1/10 beam angle of 38° is obtained (configuration 4). In addition to the reflecting mirror 34 of the configuration 4, an embossed cover to which a light diffusion effect is given is used in combination as the front cover 14 similarly to the configuration 2, whereby a narrow to medium light distribution with a 1/10 beam angle of 40° is obtained (configuration 5).

In fixation of the tip end side part 34Pb to the base end side part 34Pa, a screw structure is used in order to facilitate attachment and detachment thereof. That is to say, a flange 37 is provided at a tip end portion of the base end side part 34Pa, and slide grooves 39 are provided in a plane of the flange 37. Meanwhile, at a base end portion of the tip end side part 34Pb, a flange 41 which is fitted in surface to the flange 37 of the base end side part 34Pa is provided. The flange 41 is provided with a slide locking piece 43, and by inserting the slide locking piece 43 into a slide groove 39 of the base end side part 34Pa and the tip end side part 34Pb is rotated, whereby the slide locking piece 43 is locked to the slide groove 39 to be incapable of falling off, and both the slide locking piece 43 and the slide groove 39 are coupled.

Returning to FIG. 7 shown above, the heat radiation section 36 is a heat radiation mechanism that radiates heat that is transferred to the base plate 32 from the COB type LED 30. Specifically, the heat radiation section 36 includes a plurality of heat radiation fins 48, and a plurality of heat pipes 50 that transfer the heat of the COB type LED 30, which is transmitted to the base plate 32, to the heat radiation fins 48.

The heat radiation fin 48 is a substantially rectangular plate member, and is formed from an aluminum plate that is a metal material excellent in heat conductivity and light in weight. The respective above described heat pipes 50 penetrate through a number of heat radiation fins 48, and these heat radiation fins 48 are stacked with predetermined spaces left from one another and are integrally bundled. As shown in FIG. 8, these heat radiation fins 48 are disposed to extend perpendicularly from a back surface 32B of the base plate 32 by a support metal fitting 49. The support metal fitting 49 supports the heat radiation fins 48 with a predetermined gap δ provided between the heat radiation fins 48 and the back surface 32B of the base plate 32, air can flow on the back surface 32B and the heat radiation fins 48 through the gap δ, and heat accumulation on the back surface 32B is restrained. A length of the heat radiation fin 48 in a direction extending from the casing 10, and the number of heat radiation fins 48 are determined in accordance with required heat radiation performance.

The heat pipe 50 is a tube body in which a working liquid is encapsulated in an inside of the heat pipe 50, and is formed by being folded into a substantially U shape. That is, as shown in FIG. 7, the heat pipe 50 integrally includes one end portion 50A that extends along the back surface of the base plate 32, a penetrating portion (not illustrated) that penetrates through the respective heat radiation fins 48, and a straight-line portion 50B (FIG. 8) that connects the one end portion 50A and the penetration portion. Here, the heat radiation fins 48 extend from the back face 15 of the casing 10, and therefore, in order to transfer the heat of the base plate 32 to both a vicinity of the casing 10 and a distant place of the casing 10, lengths of the straight-line portions 50B of some of the heat pipes 50 are different.

A plurality of pipe grooves 51 are provided on the back surface 32B of the base plate 32, and by passing the one end portions 50A of the heat pipes 50 in the respective pipe grooves 51, the heat pipes 50 are fitted in the base plate 32, and heat is collected efficiently.

A plate portion 49A included by the above described support metal fitting 49 is attached to the back surface 32B of the base plate 32 to cover open portions of the pipe grooves 51, whereby the one end portions 50A of the respective heat pipes 50 are made incapable of falling off from the pipe grooves 51.

Figure 10:
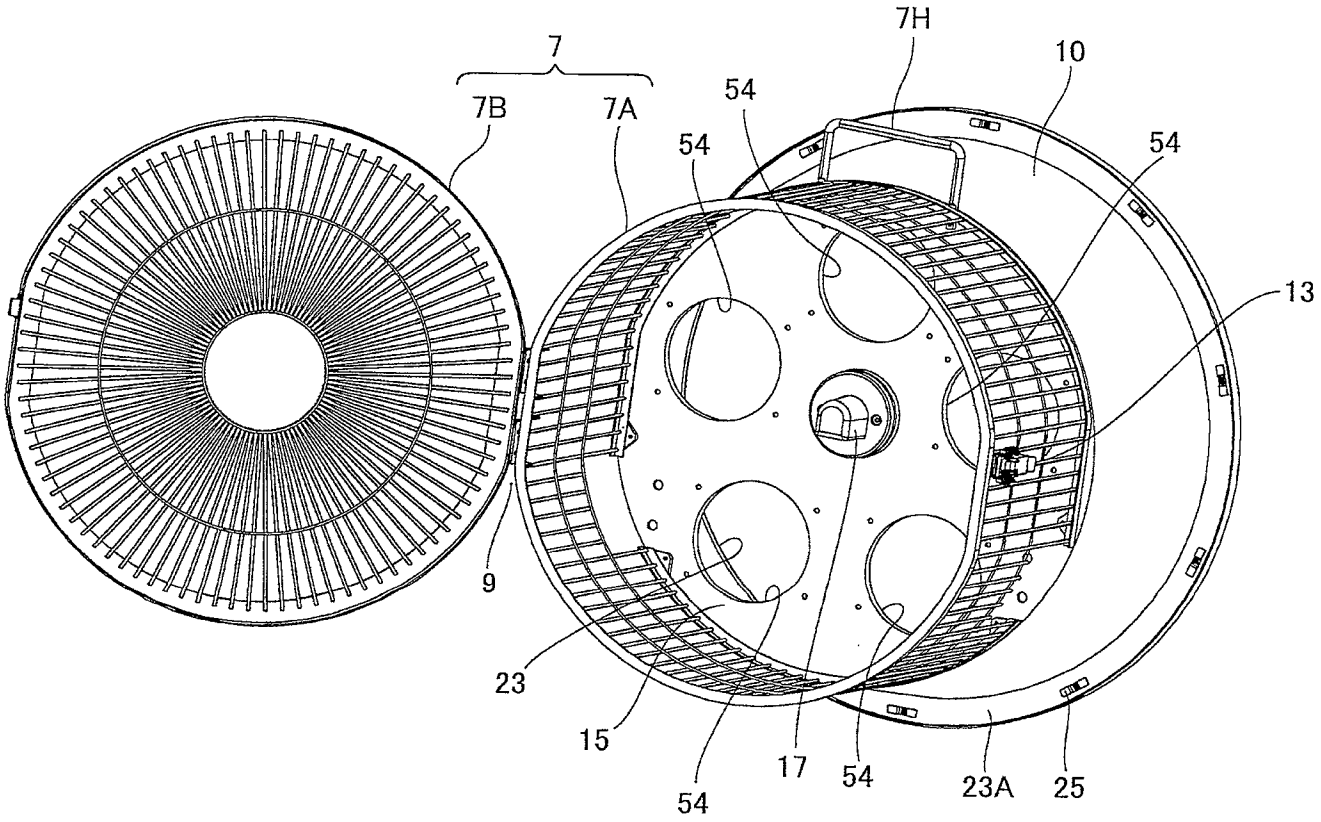
FIG. 10 is a perspective view showing a configuration of a back face side of a casing with the back face guard member.

FIG. 10 is a perspective view showing a configuration of a back face side of the casing 10 with the back face guard member 7.

The above described light source module 12 is not entirely accommodated in the casing 10, but as shown in FIG. 10, in the back face 15 of the casing 10, engaging holes 54 are provided, and as shown in FIG. 4 given above, the base plate 32 of the light source module 12 is engaged with the engaging hole 54, and is attached therein, in a state in which the heat radiation section 36 is disposed outside the casing 10 from the engaging hole 54.

At this time, as shown in FIG. 8 given above, the aforementioned insulation packing 38 which covers the entire circumference of the edge portion 56 is fitted to the edge portion 56 of the base plate 32. The insulation packing 38 is interposed between entire surfaces of contact surfaces of the back face 15 of the casing 10 and the surface 32A of the base plate 32, and ensures sufficient electrical insulation between the base plate 32 and the casing 10, in addition to that penetration of water from the engaging hole 54 is prevented.

That is, a space between the base plate 32 on which the COB type LED 30 is placed and the casing 10 is electrically insulated sufficiently by the insulation packing 38, and therefore even when a high voltage is applied to the casing 10 at the time of a withstanding voltage test, for example, an excessive voltage is not applied to the COB type LED 30 through the base plate 32. Thereby, it becomes possible to mount the COB type LED 30 directly on the base plate 32 which is formed from a metal material with a high heat radiation property as described above, the heat generated in the COB type LED 30 is efficiently transferred to the base plate 32, and the heat can be radiated from the heat radiation section 36.

Further, since the configuration in which the base plate 32 is engaged with the engaging hole 54 is adopted, the back surface 32B is exposed outside the casing 10, and the heat radiation section 36 is disposed outside the casing 10. Thereby, the heat of the heat radiation section 36 can be efficiently radiated to the outside air, and high cooling performance is obtained.

However, in the sports illumination device 1 which is installed outdoors, the heat radiation section 36 is exposed to wind and rain, and corrosion or the like occurs if any countermeasure is not taken. Therefore, in the sports illumination device 1, a corrosion-resistant coating is formed on an entire surface of the heat radiation section 36, and the corrosion resistance is enhanced. In formation of the corrosion-resistant coating, various surface treatments such as electrodeposition coating and anodic oxidation coating on aluminum can be used, but in this embodiment, electrodeposition coating of black powder is used. Surface treatment for the heat radiation section 36 is performed in a state in which the heat radiation section 36 is assembled to the base plate 32. That is, the one end portions 50A of the heat pipes 50 to which the heat radiation fins 48 are assembled are passed in the above described pipe grooves 51 of the base plate 32, and the above described surface treatment is performed in a state in which the open portions of the pipe grooves 51 are closed with the plate portion 49A of the support metal fitting 49.

Figure 11:
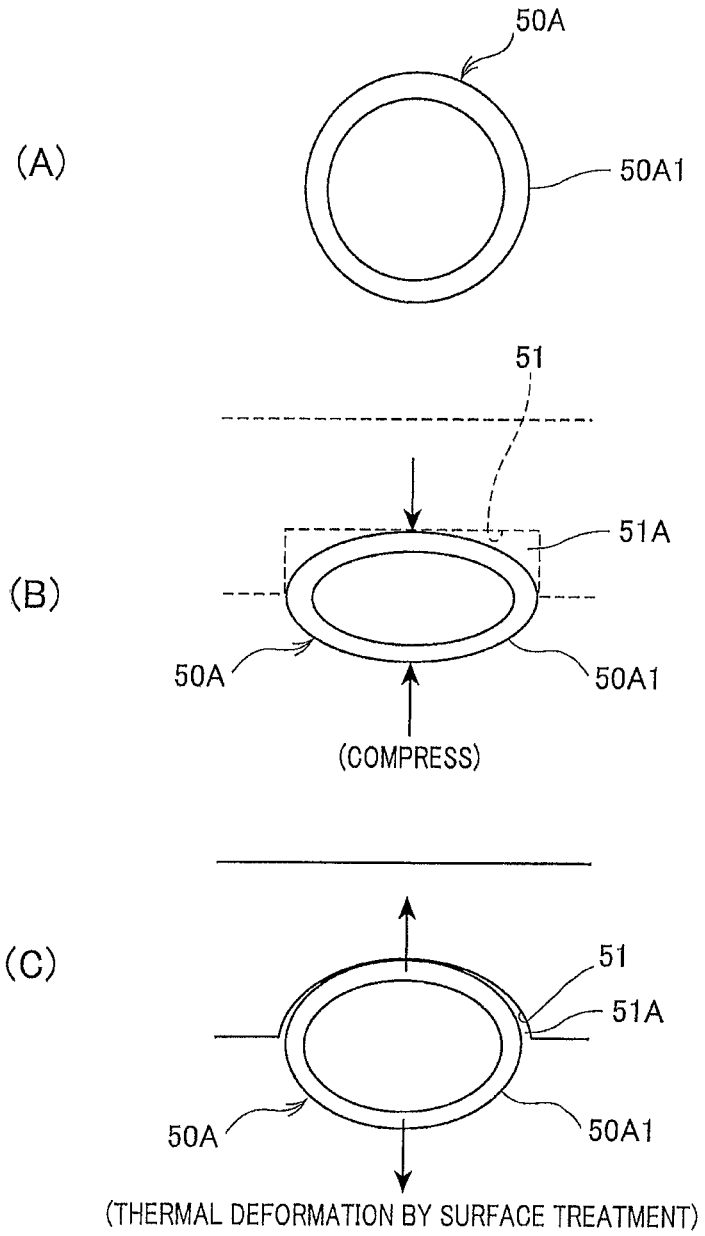
FIG. 11 is an explanatory view of an engagement structure of a pipe groove and a heat pipe, (A) is a cross section, (B) is a cross section when compressed in the radial direction, and (C) is a cross section when thermally deformed in the radial direction.

FIG. 11 is an explanatory view of an engagement structure of the pipe groove 51 and the heat pipe 50.

As shown in FIG. 11 (A), the one end portion 50A of the heat pipe 50 forms a substantially circular shape in section, and is formed into a substantially elliptic shape in section by being compressed in a radial direction as shown in FIG. 11 (B), before insertion into the pipe groove 51. By forming the one end portion 50A in the substantially elliptic shape in section, a contact area of an outer circumferential surface 50A1 of the one end portion 50A of the heat pipe 50 and the pipe groove 51 can be increased as compared when the one end portion 50A remains in a circular shape in section, even when a section 51A of the pipe groove 51 is in a rectangular shape, for example.

However, in the above described surface treatment, heat is also applied to the one end portion 50A of the heat pipe 50, whereby the one end portion 50A is thermally deformed to extend slightly in the radial direction as shown in FIG. 11 (C), and if any countermeasure is not taken, a gap is generated between the outer circumferential surface 50A1 of the one end portion 50A of the heat pipe 50 and the pipe groove 51 by the thermal deformation to cause large thermal resistance.

Further, if the section of the one end portion 50A returns to the circular shape in section by thermal deformation, the section 51A of the pipe groove 51 is formed in advance in accordance with the circular shape, whereby both of them can be brought into close contact with each other after the thermal deformation, but the one end portion 50A does not return to the circular shape in section after thermal deformation.

Therefore, as shown in FIG. 11 (C), in the sports illumination device 1, the shape of the section 51A of the pipe groove 51 is formed in advance in accordance with the shape of the outer circumferential surface 50A1 which is after heat deformation that is caused by heating to the one end portion 50A of the heat pipe 50 which accompanies the surface treatment. Thereby, the outer circumferential surface 50A1 of the one end portion 50A of the heat pipe 50 can be brought into contact with the pipe groove 51 to a large degree after thermal deformation accompanying the surface treatment, and heat is efficiently transferred to the heat pipe 50 from the base plate 32.

Incidentally, in the illumination devices using high-power type LEDs in the light sources, there is known a device in which a plurality of LEDs are provided with respective concave surface reflecting mirrors with paraboloidal surfaces of revolution, or ellipsoidal surfaces of revolution, and light of the LEDs is emitted to a distant place from the respective concave surface reflecting mirrors, as shown in Japanese Patent Laid-Open No. 2012-9280, for example.

In general, in an illumination device that includes a plurality of concave surface reflecting mirrors like this, the respective concave surface reflecting mirrors are integrally formed in advance. Accordingly, even when an impact is applied to the device main body by being fanned by wind or something colliding with the device main body, when the illumination device is used outdoors or the like, a positional deviation does not occur from one another among the respective concave surface reflecting mirrors.

However, in the case of the present embodiment, the reflecting mirrors 34 are provided independently from one another, and therefore, there is the problem that positional deviations occur from one another when an impact is applied.

Describing in more detail, when the sports illumination device 1 is installed in a ball game ground, a ball that is used in the ball game or the like sometimes collides with the sports illumination device 1. In particular, the sports illumination device 1 is configured to reduce the weight by supporting the respective plurality of reflecting mirrors 34 by coupling the base end portions 35A to the casing 10 individually, and forming the respective reflecting mirrors 34 from a resin material. Consequently, as compared with the case where the respective reflecting mirrors 34 are formed from a metal material, the respective reflecting mirrors 34 easily vibrate when an impact is applied to the device main body 2. In particular, when the respective reflecting mirrors 34 vibrate at random, positional deviations from one another occur, and a deviation occurs to the distribution characteristic of the device main body 2.

Therefore, in the sports illumination device 1, the positional deviations of the reflecting mirrors 34 accompanying an impact is prevented as follows.

That is, in the sports illumination device 1, the respective reflecting mirrors 34 which are separate from one another (that is, independent from one another) are formed into the same sizes and shapes, and thereby at least heights L (FIG. 8) from base end portions 35A to tip end portions 35B, and diameters R (FIG. 8) of openings (hereinafter, referred to as tip end openings 60) at tip end sides of the tip end portions 35B are respectively made equal to one another. Subsequently, as shown in FIG. 2 (A), these reflecting mirrors 34 are configured to be arranged equidistantly along a circumference of a circle D in such a manner that the tip end openings 60 abut on one another, and to be supported by coupling the base end portions 35A (more accurately, the base plates 32) to the casing 10 in that position.

According to the configuration, even if an impact is applied to the device main body 2, and the respective reflecting mirrors 34 vibrate with the base end portions 35A as supporting points, the respective reflecting mirrors 34 hardly vibrate at random, and therefore, occurrence of positional deviations from one another is restrained.

Further, since the reflecting mirrors 34 are disposed equidistantly on the circumference of the circle D, on the back face 15 of the casing 10, as shown in FIG. 4, the heat radiation sections 36 of the respective light source modules 12 are disposed by being shifted from one another in a lateral direction, without being aligned on the same straight line extending in an up-and-down direction. That is, when the sports illumination device 1 is installed with the back face 15 upright with respect to the horizontal plane, the respective heat radiation sections 36 are not aligned on the same straight line that extends in the vertical direction. Thereby, the influence which hot air that rises by being warmed by the heat radiation sections 36 gives to the other heat radiation sections 36 which are located above the heat radiation sections 36 is restrained, and reduction in heat radiation performance can be prevented.

In the sports illumination device 1, the respective reflecting mirrors 34 include, on the outer circumferential surfaces, the flanges 37 and 41 which are protruded in the radial direction, and therefore the flanges 37 and 41 of the respective reflecting mirrors 34 are connected by means of a plate-shaped connection body 65, as shown in FIG. 2 (A). Thereby, since points connected by the connection body 65 are supporting points of vibration when the respective reflecting mirrors 34 vibrate due to an impact or the like, the supporting points are closer to the tip end portions 35B, and amplitudes of vibration of the tip end portions 35B of the respective reflecting mirrors 34 are restrained.

Here, when the respective reflecting mirrors 34 are connected by means of the above described connection body 65, the flanges 37 of the base end side parts 34Pa at the side of the base end portions 35A are connected by means of the connection body 65, instead of the flanges 41 of the tip end side parts 34Pb which are at the sides of the tip end portions 35B of the respective reflecting mirrors 34. Specifically, as shown in FIG. 9, a plurality of bosses 63 are standingly provided on the flange 37, and by causing any one of the bosses 63 to penetrate through a positioning through-hole 65A (FIG. 12 (B)) in the connection body 65, each of the flanges 37 is connected to the connection body 65. Thereby, only the tip end side part 34Pb can be easily attached and detached by being rotated, while the base end side part 34Pa is kept to be fixed to the casing 10.

However, although the positional deviations from one another due to vibration of the respective reflecting mirrors 34 are restrained, there is the problem that the tip end side parts 34Pb rotate because vibration itself occurs, and looseness occurs to the site of coupling. Further, when the respective reflecting mirrors 34 are not connected by means of the connection body 65, the reflecting mirrors 34 rotate relatively to the casing 10 as a matter of course, and looseness also occurs to coupling of the casing 10 and the base end portions 35A of the reflecting mirrors 34.

Therefore, as shown in FIG. 6, in the sports illumination device 1, engaging grooves 66 that are engaged with one another are provided throughout entire circumferences at edge portions 60A of tip end openings 60 of the respective reflecting mirrors 34. Thereby, when the respective reflecting mirrors 34 vibrate, rotation in a direction to loosen screwing is restrained by engagement of the respective engaging grooves 66, and looseness in the screw coupling of the respective reflecting mirrors 34 (the tip end side parts 34Pb in the present embodiment) is restrained.

Figure 12:
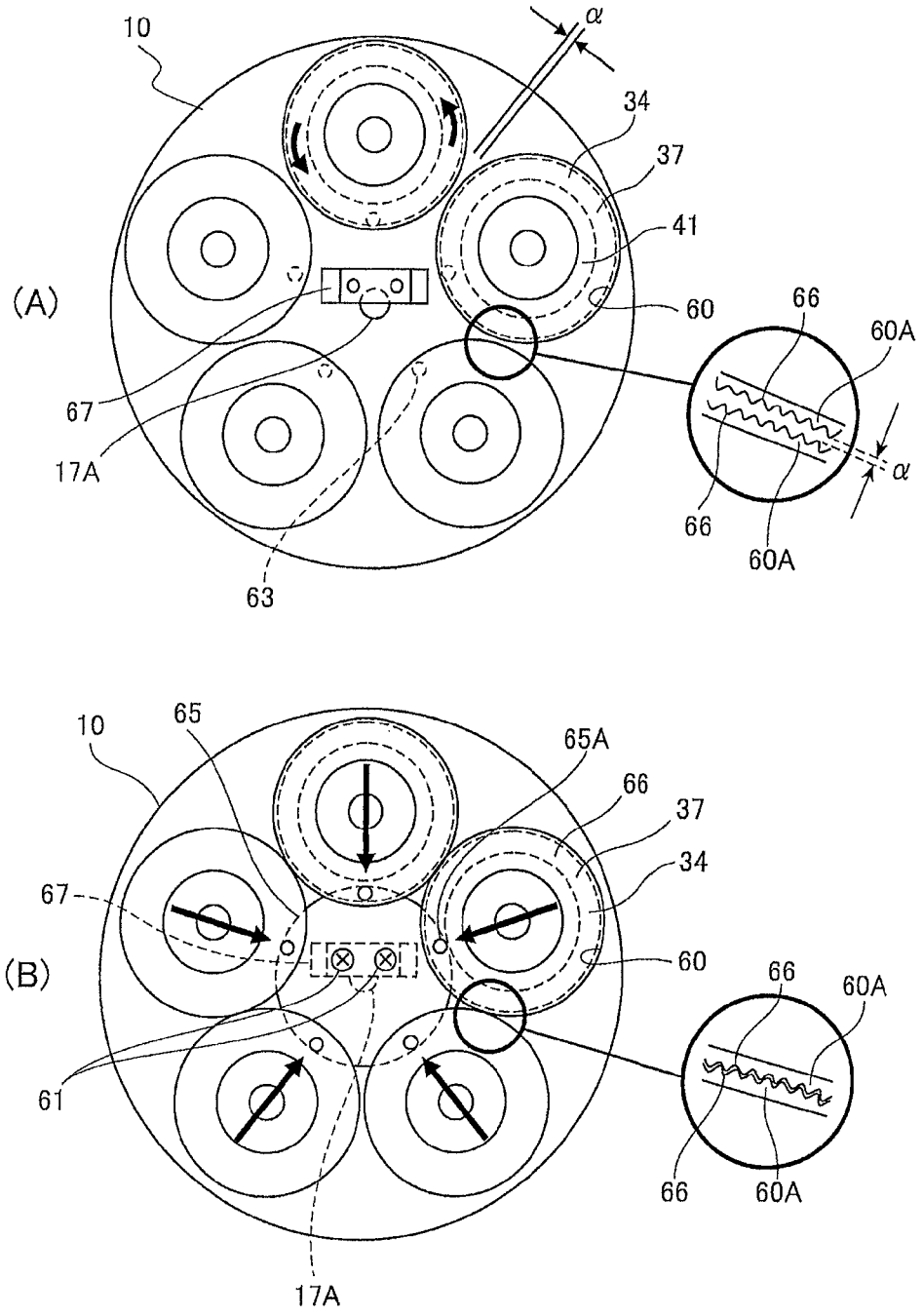
FIG. 12 is an explanatory view of a connection structure of the reflecting mirror and a connection body, (A) is the structure at the time of mounting and (B) is the structure when the connection body is fixed.

FIG. 12 is an explanatory view of a connection structure of the reflecting mirrors 34 and the connection body 65.

When the reflecting mirror 34 is assembled to the casing 10, the reflecting mirror 34 is mounted by coupling the base end portion 35A of the reflecting mirror 34 to the reflecting mirror fixture 42 of the base plate 32 which is mounted to the engaging hole 54 of the casing 10 as described above. At the time of mounting, as shown in FIG. 12 (A), gaps $\alpha$ are provided among the edge portions 60A of the tip end openings 60 of the respective reflecting mirrors 34.

In a substantially center of a bottom surface of the casing 10, a leading-in hole 17A for the power supply line is provided to correspond to the above described leading-in section 17, the connection body support metal fitting 67 is provided over the leading-in hole 17A, and the above described connection body 65 is fixed to the connection body support metal fitting 67.

When the connection body 65 is fixed, prior to screwing to the connection body support metal fitting 67, the bosses 63 on the flanges 37 in the respective reflecting mirrors 34 are connected by being passed through the positioning through-holes 65A of the connection body 65, as shown in FIG. 12 (B). By the connection, the tip end openings 60 of the respective reflecting mirrors 34 are drawn to a center portion of the casing 10. Subsequently, the connection body 65 is fixed to the connection body support metal fitting 67 with two screws 61, whereby the edge portions 60A of the tip end openings 60 of the respective reflecting mirrors 34 contact one another to be positioned so that the engaging grooves 66 are engaged with one another.

Thereby, the tip end openings 60 of the respective reflecting mirrors 34 are positioned in accurate positions, and rotation of the respective reflecting mirrors 34 at a time of an impact being applied is prevented by engagement of the engaging grooves 66.

Incidentally, for lighting in a gymnasium and the like, illumination devices that are installed by being suspended from high ceilings have been conventionally used. In this kind of illumination device, a guard member for protecting the illumination device from collision by a ball which is used in a ball game is generally provided or other objects. Further, as shown in Japanese Patent Laid-Open No. 7-141903, for example, a guard member is similarly provided in an illumination device for use in sports illumination in an outdoor baseball ground or stadium.

In a case of protecting an illumination device with a guard member, the guard member is generally provided at a device main body to cover an emission surface in order to protect a front cover that covers the emission surface of the device main body from breakage. Further, when a structure with relatively low strength is provided at a back face side of the device main body which is at an opposite side from the emission surface, the structure needs to be also protected by being covered with a guard member similarly to the emission surface.

However, when the back face side is covered with the guard member in the illumination device at a high ceiling, a dimension of the gap between the device main body and the ceiling surface is limited, and therefore, there arises the problem that when an access is made to the structure at the back face side for the purpose of maintenance or the like, an operation of removing the guard member or the like is difficult.

Further, in the illumination device for outdoor sports illumination, the device main body is installed in an aisle for spectators or in a vicinity of a spectator stand in some cases, and a space behind the device main body cannot be taken to be large in some cases. In this case, there is also the problem that an operation of removing a guard member or the like is difficult, similarly to the illumination device at a high ceiling.

Since the sports illumination device 1 of the present embodiment is installed in an outdoor ball game ground or the like, a ball or the like may collide with the sports illumination device 1 as described above, but in the sports illumination device 1, the front cover 14 is formed from polycarbonate excellent in impact resistance and therefore is hardly broken with respect to collision of a ball or the like, and the guard member as in the conventional sports illumination device is not needed.

However, in the sports illumination device 1, a plurality of heat radiation sections 36 are provided in the casing 10, as the structure 24 which is protruded from the back face 15. The respective heat radiation sections 36 include the heat radiation fins 48 which are formed from a metal plate of an aluminum or the like as described above, and therefore, are easily broken by collision by a ball or the like.

Therefore, in the sports illumination device 1, the aforementioned back face guard member 7 which protects the structure 24 which is protruded from the back face 15 is provided in the casing 10.

The back face guard member 7 includes the tubular section 7A that is mounted to the back face 15 of the casing 10 and surrounds a periphery of the structure 24, and the opening and closing section 7B that is coupled to an open end of the tubular section 7A with the hinge coupling section 9 and is openable and closable in a back direction of the casing 10, as described above. At a time of maintenance such as cleaning of the structure 24, a maintenance work or the like can be performed by opening the opening and closing section 7B in the back direction of the casing 10.

However, as described above, in an outdoor ball game ground, the sports illumination devices 1 are often installed in positions close to a spectator stand and an aisle with their backs to the spectator stand and the aisle, and a large working space cannot be prepared behind the device main body 2 in some cases.

In particular, a space required to open and close the opening and closing section 7B cannot be prepared in some cases, and in those cases, maintenance of the structure 24 is not easy.

Therefore, in the sports illumination device 1, in order to enhance maintainability, the opening and closing section 7B is configured to be removable from the tubular section 7A by moving the opening and closing section 7B parallel (that is, a substantially perpendicular direction to an opening and closing direction in the back direction) with an open face of the tubular section 7A as described above.

Figure 13:
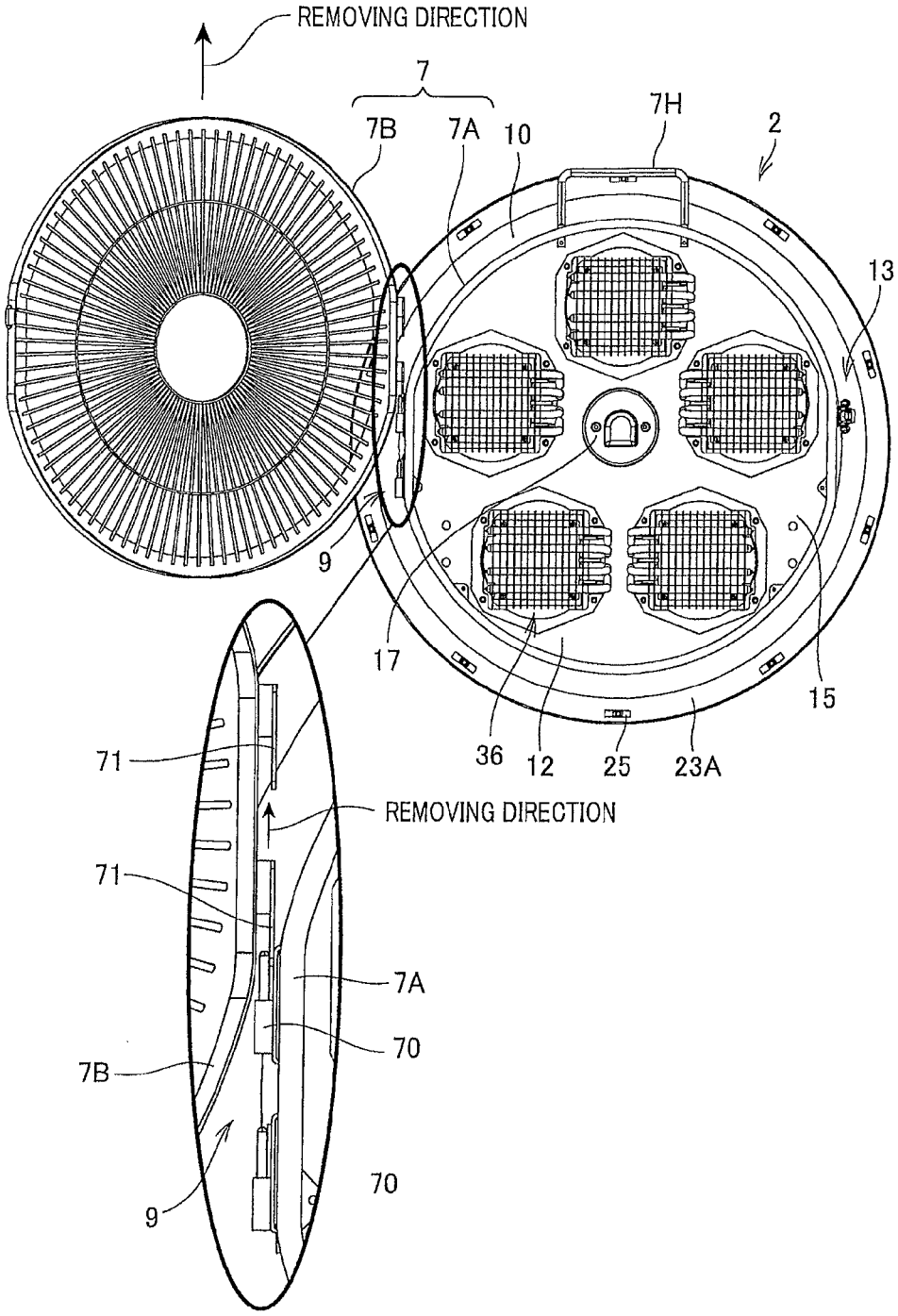
FIG. 13 is a rear view of the device main body showing a state in which an opening and closing section of the back face guard member is removed by slide movement.

FIG. 13 is a rear view of the device main body 2 showing a state in which the opening and closing section 7B of the back face guard member 7 is removed from a direction substantially perpendicular to the opening and closing direction.

The opening and closing section 7B is coupled to the tubular section 7A to be openable and closable by the hinge coupling section 9 as described above, and the hinge coupling section 9 includes a plurality of hinges 9A as shown in FIG. 3 given above. In the hinge 9A, a so-called insertable/extractable hinge (also called an extractable hinge) that is configured in such a manner that a shaft portion 72 is divided and a pair of hinge pieces 70 and 71 are insertable and extractable as shown in FIG. 13 is used. At this time, if coupling of the tubular section 7A and the opening and closing section 7B are only by the hinge 9A, the opening and closing section 7B falls off depending on the installed posture of the device main body 2. In relation to this, in the back face guard member 7, the opening and closing section 7B is locked to the tubular section 7A to be incapable of opening and closing by a latch mechanism 13 at a site facing the hinge 9A, and therefore, falling-off of the opening and closing section 7B is prevented.

As the hinge coupling section 9, an arbitrary component can be used in place of the aforementioned insertable/extractable hinge if only it is a mechanism or a component that opens and closes the opening and closing section 7B of the back face guard member 7 and makes the opening and closing section 7B removable from the direction substantially perpendicular to the opening and closing direction.

By the configuration as above, even if a sufficient space for opening the opening and closing section 7B does not exist behind the device main body 2, the hinge 9A of the hinge coupling section 9 is extracted by opening the opening and closing section 7B to some degree, and moving the hinge 9A in an axial direction of the shaft portion 72 (the removing direction) to extract the hinge 9A. Thereby, the opening and closing section 7B is removed from the axial direction of the shaft portion 72, and maintenance of the structure 24 can be easily performed.

In particular, when the device main body 2 of the sports illumination device 1 is installed by being suspended from the indoor ceiling surface (for example, a high ceiling surface of a gymnasium), it is difficult to ensure a sufficient space to open the opening and closing section 7B between the device main body 2 and the ceiling surface. In such a case, according to the sports illumination device 1, the opening and closing section 7B is removed by being caused to slide and move in the direction perpendicular to the opening and closing direction, and maintenance of the structure 24 is enabled.

As described above, according to the present embodiment, the following effects are provided.

That is, according to the sports illumination device 1 of the present embodiment, the base plate 32 on which the LED substrate 31 of the COB type LED 30 is mounted is configured to be engaged with the engaging hole 54 of the casing 10 in the state in which a part of the base plate 32 (that is, the back surface 32B) is exposed outside the casing 10. By this configuration, the heat of the COB type LED 30 which is transferred to the base plate 32 can be efficiently radiated from the site which is exposed outside of the casing 10.

In addition, the configuration is adopted, in which the insulation packing 38 which is the electrical insulation member is provided on the site of contact of the base plate 32 and the engaging hole 54 in the casing 10, and the configuration is adopted, in which electrical insulation between the base plate 32 and the casing 10 is sufficiently ensured, and sufficient withstanding voltage performance is obtained.

Thereby, the LED substrate 31 is directly attached to the base plate 32 without interposing the electrical insulation member between the base plate 32 and the LED substrate 31, and sufficient withstanding voltage performance is obtained while heat transfer is made favorable.

Further, according to the present embodiment, the sports illumination device 1 is configured to include the heat radiation sections 36 which protrude outside the casing 10 from the engaging holes 54 and radiate heat of the base plates 32.

By this configuration, the heat of the COB type LEDs 30 which is transferred from the COB type LEDs 30 to the base plates 32 can be directly radiated to outside the casing 10 through the heat radiation sections 36 from the base plates 32, and high cooling performance is obtained.

Further, according to the present embodiment, the heat radiation section 36 is configured to include the heat radiation fins 48 which are disposed outside the casing 10, and the heat pipes 50 which transfer the heat, which is transferred to the base plate 32 from the COB type LED 30, to the heat radiation fins 48.

By this configuration, the lengths of the heat radiation fins 48 extending outside from the casing 10 are made variable, and required heat radiation performance can be obtained.

In addition to this, the heat of the base plate 32 can be efficiently transferred to proper sites of the heat radiation fins 48 through the heat pipes 50, and therefore, the entire surface of the heat radiation fins 48 can be effectively used for heat radiation.

Further, the base plate 32 is provided with the pipe grooves 51 in which the heat pipes 50 pass, and the sections of the pipe grooves 51 are made to have dimensions and shapes with which the outer circumferential surfaces of the heat pipes are brought into close contact with them by thermal deformation which occurs due to heating of the heat pipes accompanying the surface treatment for enhancing corrosion resistance of the surfaces.

Thereby, even if the surface treatment is applied to the heat pipes 50, close contact of the base plate 32 and the heat pipes 50 is kept, and favorable heat radiation performance is ensured.

Further, according to the present embodiment, the respective reflecting mirrors 34 are arranged on the same circumference, and the base end portions 35A are coupled to the casing 10 in such a manner that the edge portions 60A of the tip end openings 60 of the respective reflecting mirrors 34 keep an abutment state on the edge portions 60A of the tip end openings 60 of the adjacent reflecting mirrors 34. Thereby, even when an impact is applied to the device main body 2, the individual reflecting mirrors 34 are restrained from vibrating at random, and therefore positional deviations from one another are restrained.

Further, even when the reflecting mirrors 34 are formed from a resin material, a light device can be formed while the mutual positional deviations are sufficiently restrained.

Further, according to the present embodiment, the base end portion 35A of the reflecting mirror 34 is coupled to the casing 10 (more accurately, the base plate 32 mounted to the casing 10) by the screwing method, and the edge portions 60A of the tip end openings 60 of the respective reflecting mirrors 34 are configured to be provided with the engaging grooves 66 which are the engaging portions that are engaged with one another and restrain rotation in the direction to loosen screwing.

Further, according to the present embodiment, on the back face 15 of the casing 10, the heat radiation fins 48 of the heat radiation sections 36 are disposed in the positions corresponding to the respective reflecting mirrors 34 which are disposed on the same circumference, and therefore, the heat radiation fins 48 of the respective heat radiation sections 36 are not disposed on the same straight line. Thereby, thermal influence among the heat radiation sections 36 is restrained.

Further, according to the present embodiment, the opening and closing section 7B of the back face guard member 7 provided at the device main body 2 is configured to be removable in the direction substantially perpendicular to the opening and closing direction (the back direction). Thereby, even when a sufficient space required to open and close the opening and closing section 7B of the back face guard member 7 does not exist behind the device main body 2, the opening and closing section 7B can be removed from the direction substantially perpendicular to the opening and closing direction, and a maintenance work is facilitated.

In particular, when the heat radiation sections 36 are provided on the back face 15 of the device main body 2, the heat radiation sections 36 can be protected by the back face guard member 7.

Accordingly, even when the illumination device is used as the device for sports illumination which is installed on an indoor ceiling surface or outdoors, the heat radiation sections 36 can be protected from collision by a ball or the like by means of the back face guard member 7.

Note that the aforementioned embodiment illustrates only one aspect of the present invention, and arbitrary modifications and applications can be made within the range without departing from the gist of the present invention.

For example, the case in which the sports illumination device 1 is installed outdoors and used is illustrated in the aforementioned embodiment, but the present invention is not limited to this. That is, the sports illumination device 1 may be used with the device main body 2 of the sports illumination device 1 fixed to irradiate a spot underneath the sports illumination device 1 from a gymnasium or a ceiling surface.

Further, the present invention can be applied not only to sports illumination devices but also to illumination devices for use in lighting for various other outdoor or indoor facilities as a matter of course. In particular, the present invention can be also suitably used in an illumination device that is fixedly installed on the ceiling surface or the wall surface of a factory, and needs to be protected from collision by a working vehicle.

Further, in the aforementioned embodiment, the COB type LED 30 is illustrated as one example of the LED, but the LED is not limited to this, and an arbitrary LED can be used. Further, as the light-emitting element, an arbitrary light-emitting element such as an organic EL can be used, besides an LED.

REFERENCE SIGNS LIST

1 Sports illumination device (illumination device)
2 Device main body
6 Power supply box
7 Back face guard member
7A Tubular section
7B Opening and closing section
7H Grip section
9 Hinge coupling section
9A Hinge
10 Casing
11 Guide bar
12 Light source module
13 Latch mechanism
15 Back face
17 Leading-in section
23 Emission port
24 Structure
30 COB type LED (light-emitting element)
31 LED substrate (light-emitting element substrate)
31A light emitting section
32 Base plate (substrate mounting member)
34 Reflecting mirror
34Pa Base end side part
34Pb Tip end side part
35A Base end portion
35B Tip end portion
36 Heat radiation section
38 Insulation packing (electrical insulation member)
40 LED accommodation recessed section
48 Heat radiation fin
50 Heat pipe
51 Pipe groove
54 Engaging hole
60 Tip end opening
60A Edge portion
65 connection body
66 Engaging groove (engaging portion)
70 Hinge piece
72 Shaft portion

The invention claimed is:

1. An illumination device comprising:

a light source having a light-emitting element substrate on which a light-emitting element is mounted;

a casing;

a substrate mounting member that has the light-emitting element substrate mounted thereon and is formed from a high thermoconductive material, to which heat of the light-emitting element mounted on the light-emitting element substrate is transferred; and a heat radiation section that is protruded outside the casing from the engaging hole, and radiates heat of the substrate mounting member, wherein the casing is provided with an engaging hole with which the substrate mounting member is engaged in a state in which a part of the substrate mounting member is exposed outside the casing, an electrical insulation member is provided in a site of contact of the substrate mounting member and the engaging hole in the casing, and the heat radiation section includes a heat radiation fin that is disposed outside the casing, and a heat pipe that transfers the heat of the substrate mounting member to the heat radiation fin.

2. The illumination device according to claim 1, wherein the substrate mounting member is provided with a pipe groove in which the heat pipe passes, and a section of the pipe groove is adapted to a shape of an outer circumferential surface that is after thermal deformation which occurs due to heating to the heat pipe accompanying surface treatment.

3. An illumination device, comprising:

a light source having a light-emitting element substrate on which a light-emitting element is mounted;

a casing;

a substrate mounting member that has the light-emitting element substrate mounted thereon and is formed from a high thermoconductive material, to which heat of the light-emitting element mounted on the light-emitting element substrate is transferred, and a plurality of reflecting mirrors in shapes of bodies of revolution that are separated from each other, wherein the casing is provided with an engaging hole with which the substrate mounting member is engaged in a state in which a part of the substrate mounting member is exposed outside the casing, an electrical insulation member is provided in a site of contact of the substrate mounting member and the engaging hole in the casing, and the respective reflecting mirrors are arranged on a same circumference, and edge portions of openings at tip end sides of the reflecting mirrors adjacent to one another abut on one another.

4. The illumination device according to claim 3, further comprising:

engaging portions that are engaged with the edge portions of the openings at the tip end sides of the reflecting mirrors adjacent to one another and restrain rotation in a direction to loosen the screwing are equipped, at the edge portions of the openings at the tip end sides of the respective reflecting mirrors, wherein the respective reflecting mirrors are coupled to the casing by screw mechanism.

5. The illumination device according to claim 4, further comprising:

a plurality of the light sources; and a heat radiation section that protrudes outside of the casing from the engaging hole of the casing, and radiates heat of the substrate mounting member, wherein the heat radiation sections are disposed in positions corresponding to the respective reflecting mirrors, and the reflecting mirror is provided for each of the light sources.

6. The illumination device according to claim 4, wherein the reflecting mirror is made of a resin material.

7. The illumination device according to claim 3, further comprising:

a plurality of the light sources;

and a heat radiation section that protrudes outside of the casing from the engaging hole of the casing, and radiates heat of the substrate mounting member, wherein the heat radiation sections are disposed in positions corresponding to the respective reflecting mirrors, and the reflecting mirror is provided for each of the light sources.

8. The illumination device according to claim 7, wherein the reflecting mirror is made of a resin material.

9. The illumination device according to claim 3, wherein the reflecting mirror is made of a resin material.

10. An illumination device comprising:

a light source having a light-emitting element substrate on which a light-emitting element is mounted;

a casing;

a substrate mounting member that has the light-emitting element substrate mounted thereon and is formed from a high thermoconductive material, to which heat of the light-emitting element mounted on the light-emitting element substrate is transferred;

a heat radiation section that protrudes outside from a back face of the casing from the engaging hole, and radiates heat of the substrate mounting member; and a back face guard member that is provided at the casing, and covers the heat radiation section at the back face, wherein the casing is provided with an engaging hole with which the substrate mounting member is engaged in a state in which a part of the substrate mounting member is exposed outside the casing, an electrical insulation member is provided in a site of contact of the substrate mounting member and the engaging hole in the casing, the back face guard member includes an opening and closing section that opens and closes in a back direction of the casing, and the opening and closing section is provided to be removable in a direction substantially perpendicular to the back direction.

* * * * *